US006279620B1

(12) United States Patent
Eason et al.

(10) Patent No.: US 6,279,620 B1
(45) Date of Patent: Aug. 28, 2001

(54) TOOL HEAD FOR AUTOMATIC CABLE TIE INSTALLATION SYSTEM

(75) Inventors: P. Michael Eason, Lakeland; Lane Moultrie, Memphis, both of TN (US)

(73) Assignee: Thomas & Betts International, Sparks, NV (US)

( * ) Notice: Subject to any disclaimer, the term of this patent is extended or adjusted under 35 U.S.C. 154(b) by 0 days.

(21) Appl. No.: 09/575,034

(22) Filed: May 19, 2000

(51) Int. Cl.[7] ..... B21F 9/02
(52) U.S. Cl. ..... 140/93.2; 140/123.6
(58) Field of Search ..... 140/93 A, 93.2, 140/123.6

(56) References Cited

U.S. PATENT DOCUMENTS 4,498,506 2/1985 Moody et al. .
4,790,225 12/1988 Moody et al. .

*Primary Examiner*—Lowell A. Larson
(74) *Attorney, Agent, or Firm*—Hoffman & Baron, LLP

(57) ABSTRACT

An improved tool head for use with an automatic cable tie installation system providing improved reliability, and reduced jamming and/or failure. The improved tool head incorporates a structurally rigid frame which locates and supports the interacting and cooperating components of the tool head in a precise relationship despite such factors as flexing and twisting of the housing, thermal expansion and contraction of the housing, and operational wear.

16 Claims, 7 Drawing Sheets

TOOL HEAD FOR AUTOMATIC CABLE TIE INSTALLATION SYSTEM

BACKGROUND OF THE INVENTION

The present invention relates to a tool head and, more particularly, to a tool head for use with an automatic cable tie installation system providing improved performance and reliability.

As is well-known to those skilled in the art, cable ties are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage and engages the body of the tail to secure the tail to the head.

Although cable ties are often installed manually, it is desirable in certain applications to utilize an automatic cable tie installation system wherein cable ties are dispensed from a remote dispenser, and thereafter delivered to a tool head for application about a bundle of wires positioned within the jaws of the tool head. Automatic cable ties installation systems are well-known in the art, and are disclosed for example in U.S. Pat. Nos. 4,790,225 and 4,498,506. It will be appreciated that the disclosed tool heads include a plurality of subassemblies each having multiple moving parts, the subassemblies cooperating together to deliver, tension and cut the cable tie. To be commercially practical, the tool head must be capable of repeatedly applying a cable tie about the bundle of articles inserted within the jaw assembly without jamming. The tool head must also be able to complete a cycle (wherein one cable tie is wrapped, tensioned and cut) within a sufficiently short interval of time.

Those skilled in the art will appreciate that the foregoing requirements demand extremely accurate and precise location and support of the various cooperating components of the tool head. These prior art tool heads, including the tool heads disclosed in the mentioned patents, often locate and support many of the internal cooperating components via the housing shells. These housing shells are typically formed of plastic and are susceptible to flexing and twisting during operation which can adversely affect the cooperation between the components of the tool head, thus leading to jamming and/or failure of the tool head. Moreover, the practice of locating the various cooperating components of the tool head with respect to more than one reference structure (e.g., the two separate housing shells) allows the manufacturing tolerances associated with the individual components to be combined, which may lead to misalignment of the components.

There is therefore a need in the art for a tool head for use with an automatic cable tie installation system which exhibits improved reliability, and reduced jamming and/or failure. The improved tool head should maintain an accurate and precise relationship between the interacting and cooperating components of the tool head even when the tool head is subjected to such factors as flexing and twisting of the housing, thermal expansion and contraction of the housing, and operational wear.

SUMMARY OF THE INVENTION

The present invention, which addresses the needs of the prior art, relates to a tool head for installation of a cable tie about a bundle of elongate articles. The tool head is adapted for use with a remote dispenser, cable tie bandolier and cable tie delivery hose of an automatic cable installation system. The cable tie includes a head and an elongate tail extending therefrom. The tool head includes a housing including first and second cooperating shells. The tool head further includes a jaw assembly for grasping and directing the cable tie about the articles. The tool head further includes a tie passage communicating at one end with the cable tie delivery hose and at the other end with the jaw assembly whereby a cable tie supplied by the remote dispenser is delivered to the jaw assembly. The tool head further includes a tie tensioning assembly for tensioning the cable tie upon installation of the cable tie about the elongate articles. The tie tensioning assembly includes a drive train and a pawl gear cut-off mechanism. Finally, the tool head includes a structurally rigid frame sized for location within the housing. The frame provides a fixed and common reference structure independent of the housing to both support the pawl gear cut-off mechanism and to locate the pawl gear cut-off mechanism with respect to the drive train.

As a result, the present invention provides a tool head for use with an automatic cable tie installation system which exhibits improved reliability, and reduced jamming and/or failure. The structurally rigid frame utilized in the improved tool head maintains an accurate and precise relationship between the interacting and cooperating components of the tool head even when the tool head is subjected to such factors as flexing and twisting of the housing, thermal expansion and contraction of the housing, and operational wear.

DETAILED DESCRIPTION OF THE INVENTION

Figure 1:
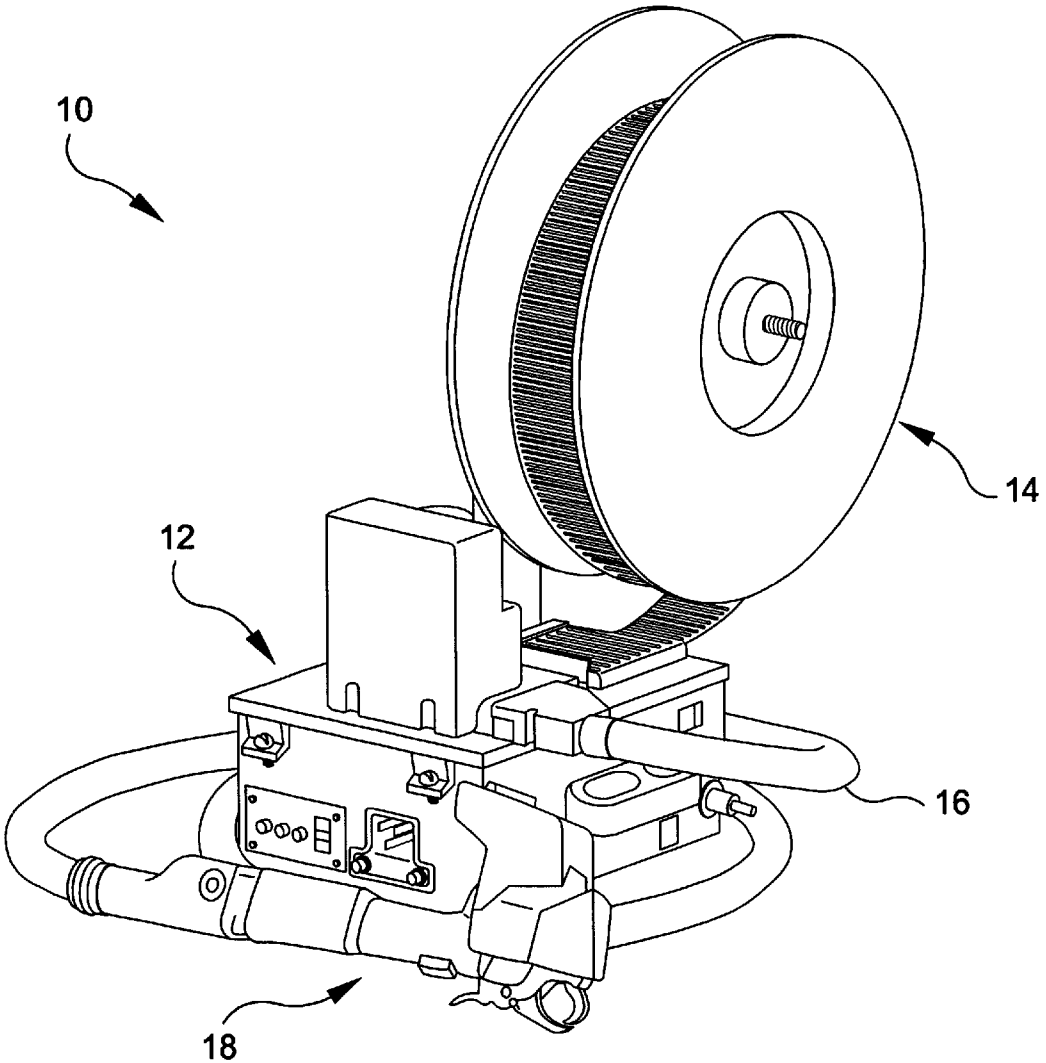
FIG. 1 is a perspective view of an automatic cable tie installation system.

Referring now to the drawings, an automatic cable tie installation system 10 is shown in FIG. 1. Installation system 10 includes a cable tie dispenser 12 (as described in commonly-owned pending U.S. application Ser. No. 09/377,650, incorporated herein by reference), a cable tie bandolier 14 (as described in commonly-owned U.S. Pat. Nos. 5,934,465 and 5,967,316, incorporated herein by reference), a cable tie delivery hose 16 and a tool head 18. In operation, dispenser 12 severs the leading cable tie from bandolier 14, and thereafter propels the individual cable tie to the tool head via hose 16. The cable tie is wrapped about a bundle of articles positioned within the jaws, tensioned and is then subjected to a cutting operation whereby the excess portion of the cable tie tail is cut from the tensioned cable tie.

Figure 2:
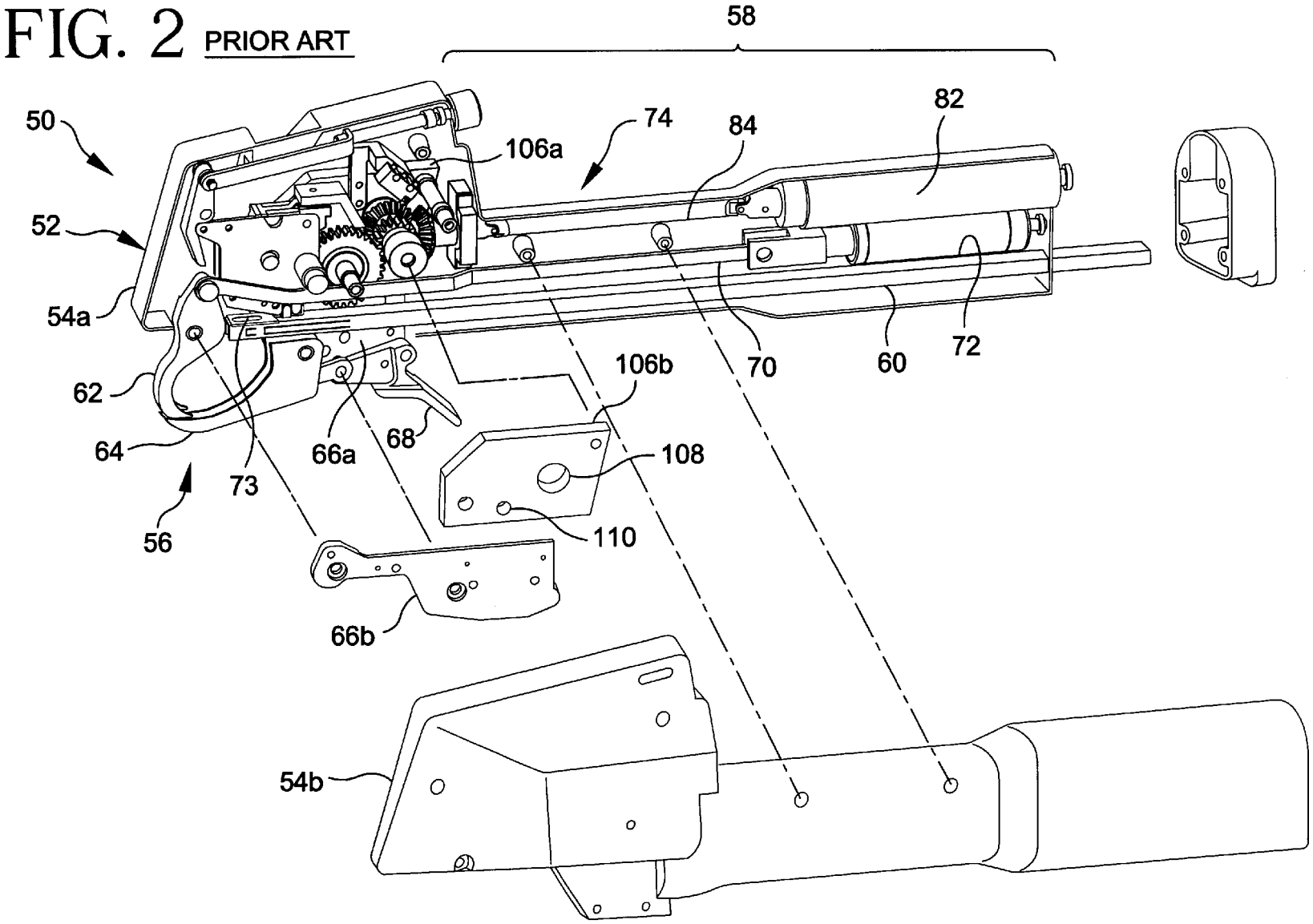
FIG. 2 PRIOR ART
FIG. 2 is an exploded perspective view of a prior art tool head.
Figure 2A:
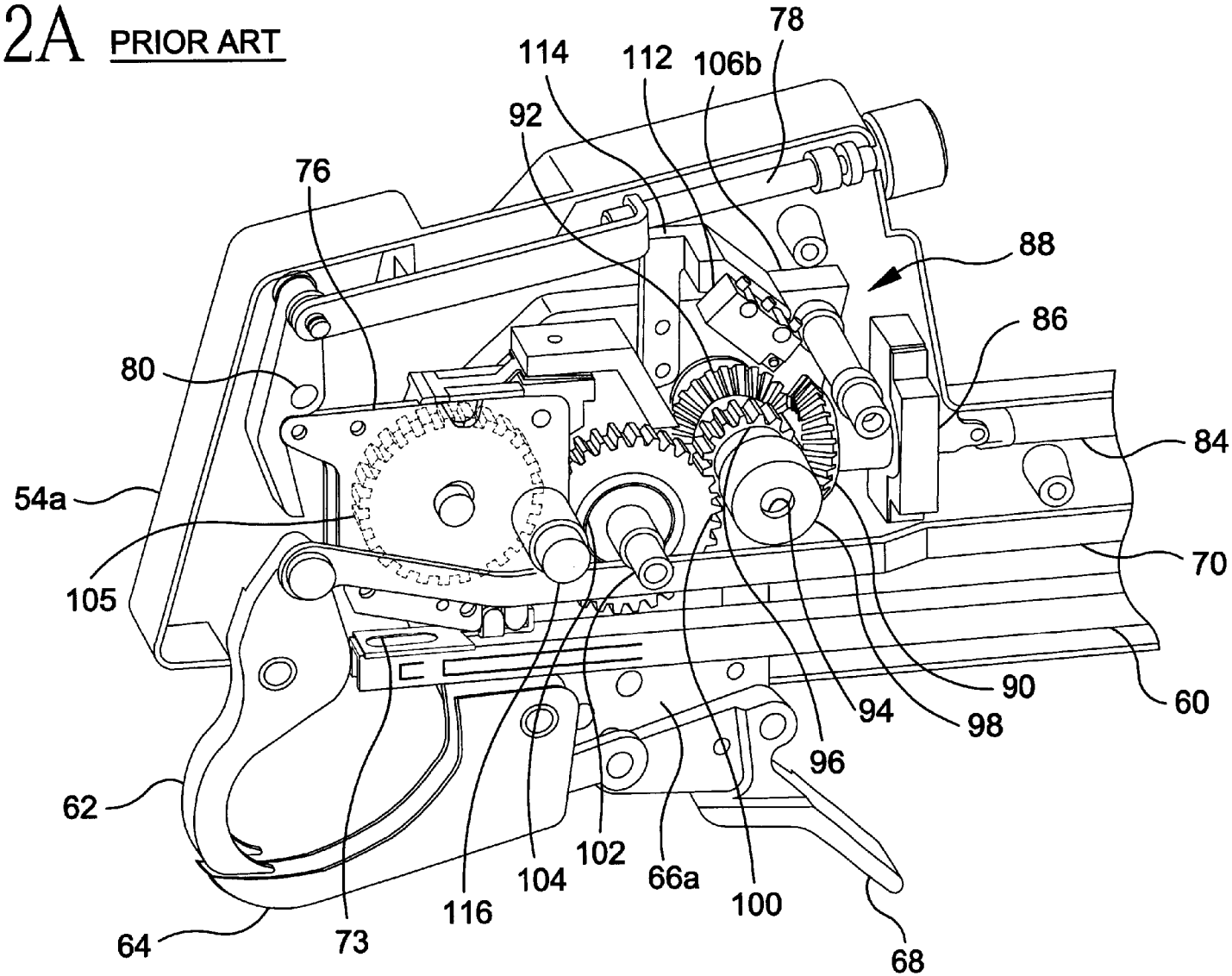
FIG. 2A PRIOR ART
FIG. 2*a* is an enlarged detail of FIG. 2.
Figure 3:
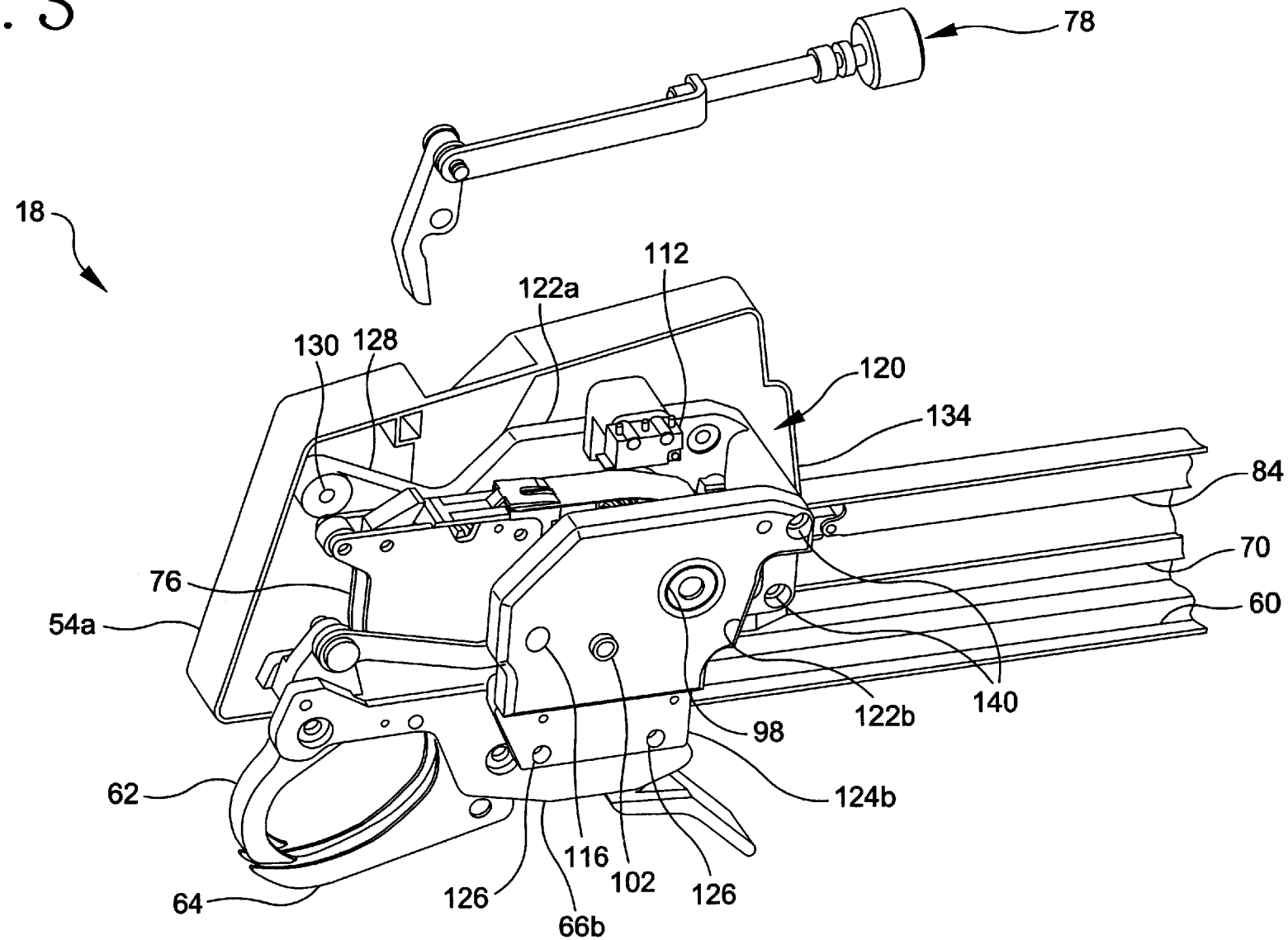
FIG. 3 is an exploded perspective view of a tool head in accordance with the present invention.

The operating components of a prior art tool head 50 are shown in FIGS. 2 and 2A. In this regard, the general operation of tool head 50 is well-known to those skilled in the art. As discussed hereinabove, U.S. Pat. Nos. 4,498,506 and 4,790,225, both of which are incorporated herein by reference, disclose the structure and operation of a prior art tool head.

As will be appreciated by those skilled in the art, the housing of tool head 50, i.e., housing 52, is preferably formed from first and second cooperating shells 54*a*, 54*b*, such shells being used to both support and locate the various components of the tool head. Although it is commercially desirable to form shells 54*a*, 54*b* from a plastic material, this construction introduces the possibility that housing 52 may flex and twist during operation which can lead to misalignment of the cooperating components, and ultimately jamming and/or failure of the tool head.

Tool head 50 includes jaw assembly 56, tie tensioning assembly 58, and a tie passage 60 communicating at one end with cable tie delivery hose 16 and at the other end with jaw assembly 56 whereby a cable tie supplied by remote dispenser 12 is delivered to the jaw assembly.

Jaw assembly 56 includes in particular a top jaw 62, a bottom jaw 64, opposing jaw-mounting plates 66*a*, 66*b*, a trigger 68 connected to bottom jaw 64 for moving the bottom jaw between an open position and a closed position, a push rod 70 for moving top jaw 62 during installation of the cable tie about the bundle of elongate articles, a power-operated device 72 for powering said push rod, and a cutting mechanism 73 supported between jaw-mounting plates 66*a*, 66*b*.

Tie tensioning assembly 58 includes in particular a drive train 74, a pawl gear cut-off mechanism 76 and a tension adjustment mechanism 78 pivotable about a pivot point 80. Cutting mechanism 73 cooperates with pawl gear cut-off mechanism 76 to cut off any excess portion of the tail from the tensioned cable tie.

In turn, drive train 74 includes a power-operated device 82, a driveshaft 84 coupled at one end to power operated device 82, a driveshaft bearing for supporting the other end of driveshaft 84 positioned within a housing 86, and a gear assembly 88. In turn, gear assembly 88 includes a first bevel gear 90 positioned at the end of the driveshaft 84, a second bevel gear 92 fixedly coupled to a shaft 94 and located to engage first bevel gear 90, a drive gear 96 also fixedly coupled to shaft 94, a pair of opposing bearings 98 for rotatably supporting shaft 90, and an idler gear 100 rotatably coupled to a shaft 102 via a bearing 104 and located to cooperate with the pawl gear cut-off mechanism 76. As a result, rotary motion may be transmitted from driveshaft 84 to the internal gear 105 (shown in hidden line in FIG. 2A) of pawl gear cut-off mechanism 76.

Gear assembly 88 further includes a pair of opposing gear-supporting plates 106*a*, 106*b*, for supporting the mentioned gears therebetween. In this regard, each of plates 106*a*, 106*b* includes an aperture 108 sized to receive bearings 98, and an aperture 110 sized to receive the end of shaft 102. A microswitch 112 for sensing the presence of a cable tie is mounted on a bracket 114, which in turn is secured to gear-supporting plate 106*a*. Gear-supporting plates 106*a*, 106*b* also pivotally support pawl gear cut-off mechanism 76 via a pair of pivot pins 116. Each of gear-supporting plates 106*a*, 106*b* include a pair of apertures 118 sized to receive the ends of pivot pins 116. Gear-supporting plates 106*a*, 106*b*, themselves are each separately supported by shells 54*a*, 54*b*, respectively, of housing 52. Thus, flexing of housing 52 can result in independent movement of each of driveshaft bearing 86, gear-supporting plate 106*a* and gear-supporting plate 106*b*.

It will be appreciated that pawl gear cut-off mechanism 76 must be properly aligned with jaw assembly 56 to receive the tail of the cable tie. Pawl gear cut-off mechanism 76 must also be properly aligned with microswitch 112 to ensure smooth operation of the tool head. Again, twisting and/or flexing of housing 52 may produce misalignment and/or movement of gear-supporting plates 106*a*, 106*b* (either together or independent of one another), thus causing misalignment of pawl gear out-off mechanism 76 with respect to jaw assembly 56. Of course, this same twisting and/or flexing of housing 52 can produce movement and misalignment of the jaw assembly itself. Finally, to ensure proper tensioning of the cable tie during operation, the location of tension adjustment mechanism 78 with respect to the pawl gear cut-off mechanism must be maintained.

Referring now to FIGS. 3–6, tool head 18 of the present invention incorporates and utilizes a novel, structurally rigid mounting frame 120, also referred to as the "unibody." Frame 120 preferably includes first and second locating plates 122*a*, 122*b*. These plates are preferably machined metal plates which are configured to be securely fixed to one another via screws and/or bolts. When assembled, the unibody forms a structurally rigid frame which provides a fixed and common reference structure independent of the housing to both support pawl gear cut-off mechanism 76 and to locate pawl gear cut-off mechanism 76 with respect to drive train 74. Preferably, the unibody also supports and locates the drive shaft bearing, supports and aligns the gear assembly, locates the jaw assembly, locates the pivot point for the tension adjustment mechanism and locates the microswitch.

Each of locating plates 122*a*, 122*b* includes a jaw-locating bracket 124*a*, 124*b* configured for securement to the jaw-mounting plates of the jaw assembly, thus locating the jaw assembly with respect to the unibody, and in turn with respect to the pawl gear cut-off mechanism. In this regard, each of brackets 124*a*, 124*b* includes a pair of screw-receiving apertures 126 which are located to align with a pair of threaded apertures (not shown) provided in each of jaw-mounting plates 66*a*, 66*b*.

Figure 4:
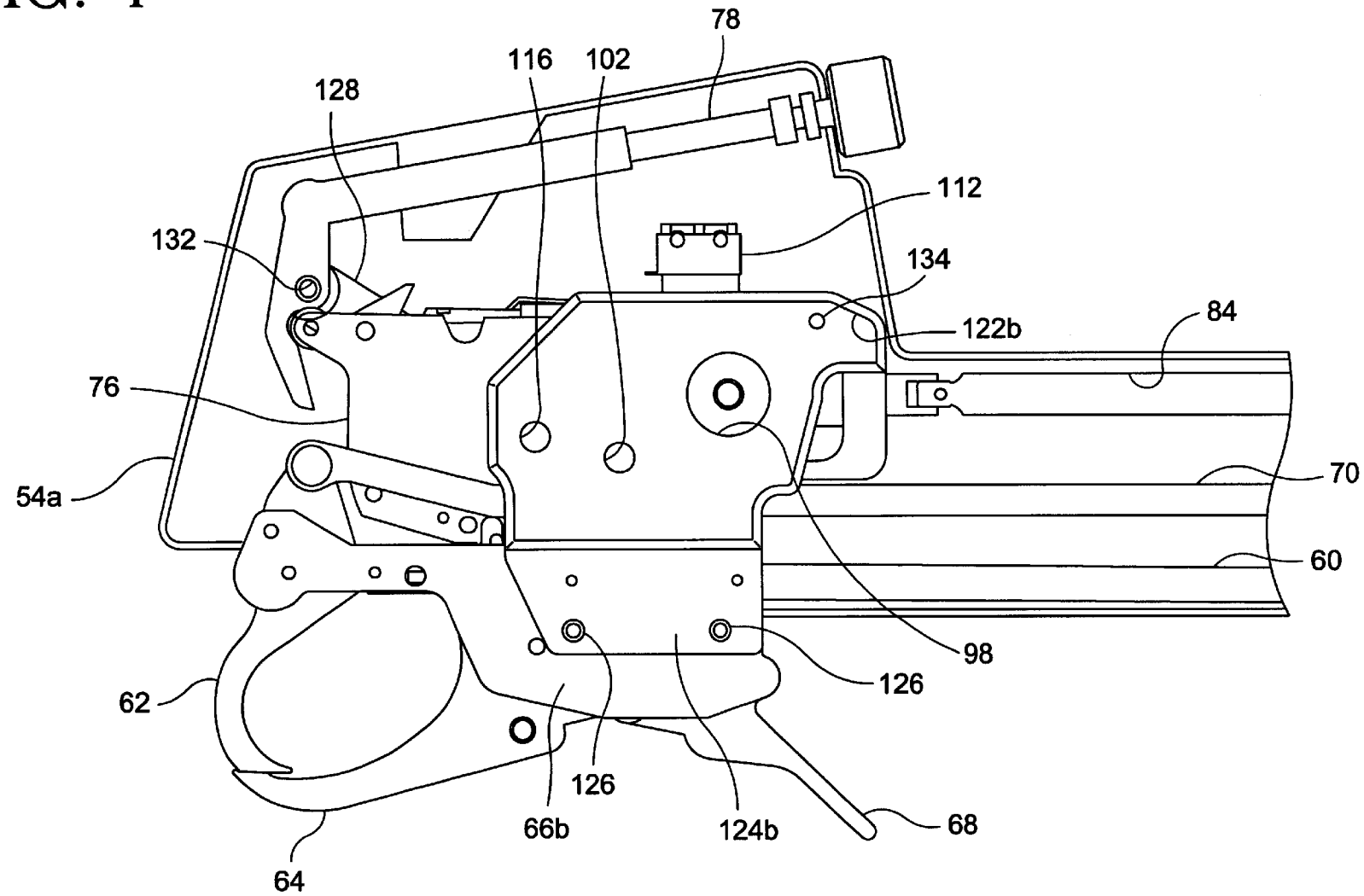
FIG. 4 is a side elevational view of the tool head of FIG. 3.
Figure 5:
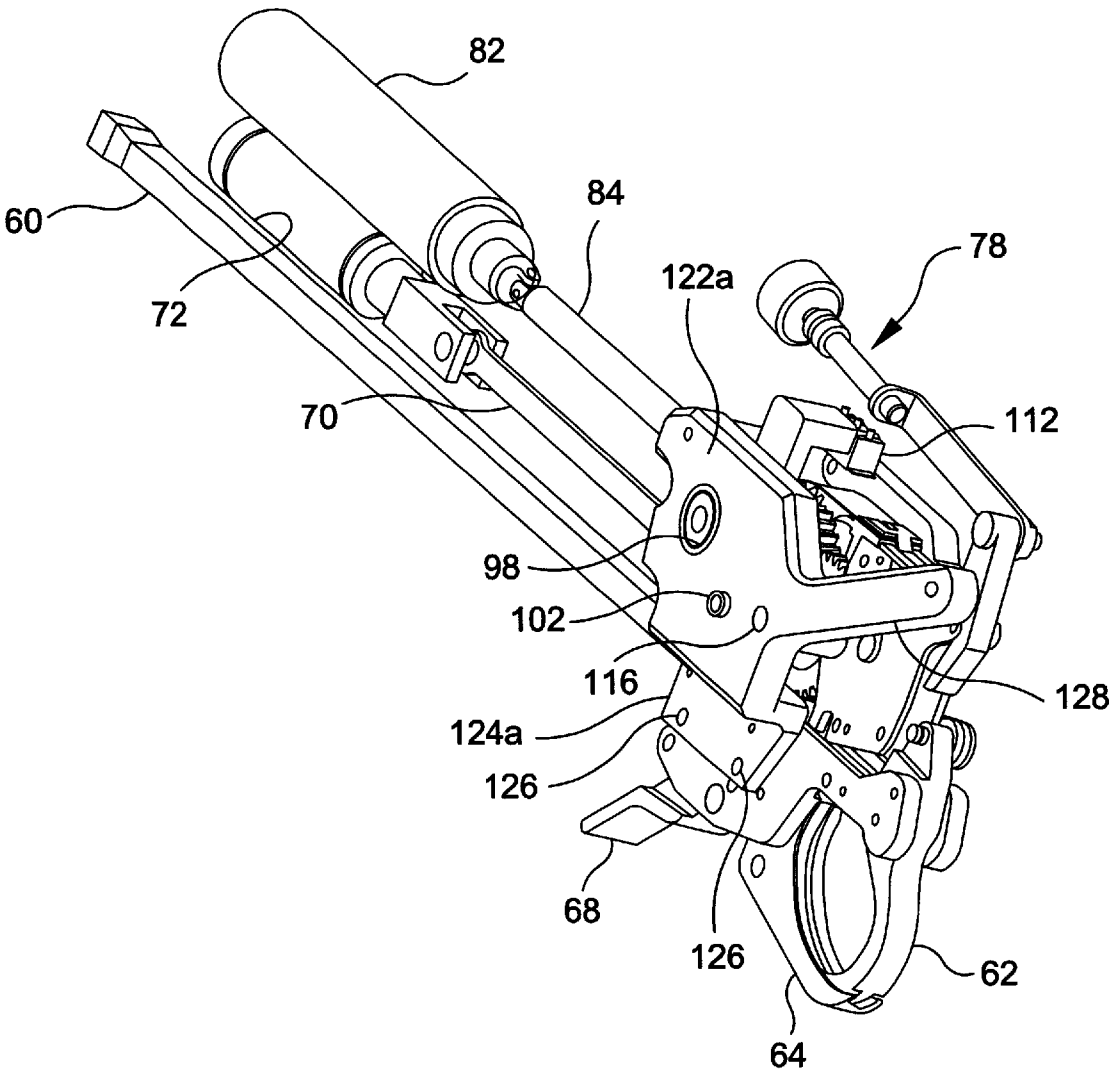
FIG. 5 is a perspective view of the components of the tool head of FIG. 3 removed from their housing.

Locating plate 122*a* also includes an arm 128 having a aperture 130, which provides the pivot point for the tension adjustment mechanism and which receives a pivot pin 132 (see FIG. 4). Accordingly, the location of pivot pin 132 is fixed with respect to pivot pins 116 (i.e., the pins that support pawl gear cut-off mechanism 76), thus ensuring proper cooperation between the tension adjustment mechanism and the pawl gear cut-off mechanism during all conditions of operation. Each of locating plates 122*a*, 122*b* further includes a threaded aperture 134 which receives a screw passing through housing shells 54*a*, 54*b*, respectively, thereby allowing shells 54*a*, 54*b* to be secured to locating plates 122*a*, 122*b*, respectively.

Figure 6:
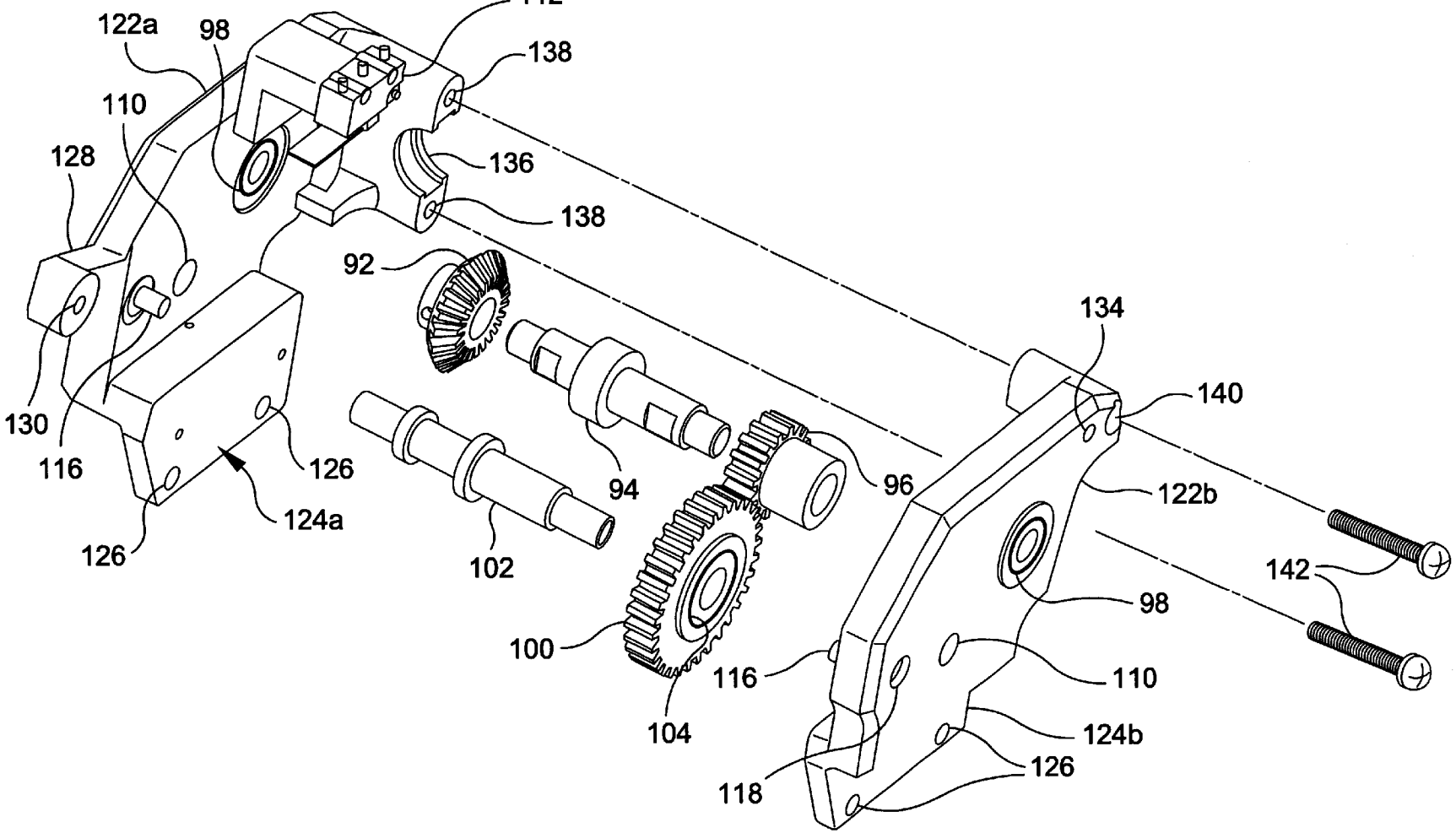
FIG. 6 is an exploded perspective view of the structurally rigid frame and gear assembly of the present invention.

Referring now to FIG. 6, locating plates 122*a*, 122*b* together provide a driveshaft bearing housing 136, which supports the driveshaft bearing. Locating plate 122*a* includes a pair of threaded apertures 138, while locating plate 122*b* includes a pair of screw-receiving apertures 140. Installation of screws 142 thus fixedly secures the locating plates to one another, and also secures the drive shaft bearing within bearing housing 136.

Thus, when the unibody is assembled within the tool head, the unibody forms a structurally rigid frame which provides a common reference for locating the various operating components of the tool head. In contrast to the use of a plastic housing for locating the tool components, the unibody is preferably formed from machined plates, thus ensuring the accuracy at which the various attachment points are located. It will be appreciated that the unibody's rigid structure ensures that all parts are held in proper orientation relative to each other, and prevents binding and misalignment of the moving components due to such factors as torque from the motors thermal expansion and contraction of the housing and operational wear. Thus, one common structure which is unaffected by flexing and/or twisting of the tool housing locates and supports the drive train, and also aligns the various subassemblies of the tool head with one another.

Although the unibody is described as including locating plate 122*a*, 122*b*, it is contemplated herein that the unibody can be formed as a single integral unit. This may of course require certain modifications to the gear assembly, to the coupling of the pawl gear cut-off mechanism to the unibody, and to the drive shaft bearing housing. However, the unibody (whether formed as a single unit or plural pieces) provides a structurally rigid frame which locates and supports the various components of the tool head to prevent binding and misalignment of such components during operation.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the followings claims.

What is claimed is:

1. A tool head for installation of a cable tie about a bundle of elongate articles, the tool head being adapted for use with a remote dispenser, cable tie bandolier and cable tie delivery hose of an automatic cable tie installation system, said cable tie including a head and an elongate tail extending therefrom, the tool head comprising:

a housing including first and second cooperating shells;

a jaw assembly for grasping and directing said cable tie about said articles;

a tie passage communicating at one end with said cable tie delivery hose and at the other end with said jaw assembly whereby a cable tie supplied by said remote dispenser is delivered to said jaw assembly;

a tie tensioning assembly for tensioning said cable tie upon installation of said cable tie about said elongate articles, said tie tensioning assembly including a drive train and a pawl gear cut-off mechanism; and a structurally rigid frame sized for location within said housing, said frame providing a fixed and common reference structure independent of said housing to both support said pawl gear cut-off mechanism and to locate said pawl cut-off mechanism with respect to said drive train.

2. The tool head according to claim 1, wherein said drive train includes a first power-operated device, a driveshaft, a driveshaft bearing and a gear assembly, and wherein said frame further locates and supports said driveshaft bearing, and said gear assembly.

3. The tool head according to claim 2, wherein said tensioning assembly further includes a tension adjustment mechanism pivotally mounted to said frame and located to cooperate with said pawl gear cut-off mechanism.

4. The tool head according to claim 3, wherein said frame includes a support arm configured to both locate and support said tension adjustment mechanism with respect to said pawl gear cut-off mechanism.

5. The tool head according to claim 4, wherein said frame includes first and second locating plates configured to be fixedly secured to one another independent of said housing.

6. The tool head according to claim 5, wherein each of said locating plates includes a jaw-locating bracket sized to cooperate with and locate said jaw assembly with respect to said frame.

7. The tool head according to claim 6, wherein said jaw assembly includes:

top and bottom jaw members;

first and second opposing jaw-mounting plates;

a trigger connected to said bottom jaw for moving said bottom jaw between an open position and a closed position;

a push rod for moving said top jaw during installation of said cable tie about said bundle of elongate articles;

a second power-operated device for powering said push rod;

a cutting mechanism supported between said jaw-mounting plates and cooperating with said pawl gear cut-off mechanism to cut off an excess portion of said tail from said tensioned cable tie; and wherein said jaw-mounting plates are positioned between and located by said jaw-locating brackets.

8. The tool head according to claim 7, wherein each of said jaw-locating brackets includes a plurality of apertures sized for passage of a screw therethrough, and wherein each of said jaw-mounting plates includes a plurality of threaded apertures whereby said jaw-locating brackets and said jaw-mounting plates may be secured together and located with respect to one another.

9. The tool head according to claim 5, wherein said locating plates include cooperating hardware-receiving passages whereby said locating plates may be removably secured to one another.

10. The tool head according to claim 5, further comprising a microswitch for sensing the presence of said cable tie, and wherein at least one of said locating plates includes a mounting surface for attachment and location of said microswitch.

11. The tool head according to claim 5, wherein said locating plates comprise machined metal components.

12. The tool head according to claim 5, wherein said locating plates provide a driveshaft bearing housing.

13. The tool head according to claim 12, wherein one of said locating plates includes a pair of threaded apertures, and wherein the other of said locating plates includes a pair of screw-receiving apertures located for alignment with said threaded apertures when said frame is assembled.

14. The tool head according to claim 5, wherein each of said locating plates includes a threaded aperture for receipt of a housing screw.

15. The tool head according to claim 5, wherein said gear assembly includes:

a first bevel gear positioned at one end of said driveshaft;

a first shaft rotatably supported by said locating plates;

a second bevel gear fixedly coupled to said first shaft and located to engage said first bevel gear;

a drive gear fixedly coupled to said first shaft;

a pair of bearings located at the ends of said first shaft;

a second shaft supported by said locating plates; and an idler gear supported by said second shaft and located to engage said drive gear and to cooperate with said pawl gear cut-off mechanism whereby rotary motion may be transmitted from said drive shaft to said pawl gear cut-off mechanism.

16. The tool head according to claim 15, wherein each of said locating plates includes:

a first aperture sized for receipt of said bearings supporting said first shaft;

a second aperture sized for receipt of the ends of said second shaft;

a pair of pivot pins sized to rotatably support said pawl gear cut-off mechanism; and a third aperture sized for receipt of said pivot pins.

* * * * *